US011333113B2

(12) United States Patent
Moine et al.

(10) Patent No.: US 11,333,113 B2
(45) Date of Patent: May 17, 2022

(54) METHOD FOR DETECTING THE CLOGGING OF AN AIR FILTER

(71) Applicant: VITESCO TECHNOLOGIES GMBH, Hanover (DE)

(72) Inventors: Xavier Moine, Toulouse (FR); Xavier Belin, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/282,684

(22) PCT Filed: Oct. 2, 2019

(86) PCT No.: PCT/EP2019/076678

§ 371 (c)(1),
(2) Date: Apr. 2, 2021

(87) PCT Pub. No.: WO2020/070179

PCT Pub. Date: Apr. 9, 2020

(65) Prior Publication Data

US 2021/0388800 A1 Dec. 16, 2021

(30) Foreign Application Priority Data

Oct. 5, 2018 (FR) ..... 1859260

(51) Int. Cl.
*F02M 35/09* (2006.01)
*F02M 35/10* (2006.01)

(52) U.S. Cl.
CPC ..... *F02M 35/09* (2013.01); *F02M 35/1038* (2013.01)

(58) Field of Classification Search
CPC ..... F02M 35/09; F02M 35/1038; F02D 2200/0406; F02D 2250/14
See application file for complete search history.

(56) References Cited

U.S. PATENT DOCUMENTS 7,012,685 B1 3/2006 Wilson
8,327,695 B2 * 12/2012 Jackson ..... G01M 15/09 73/114.37

(Continued)

FOREIGN PATENT DOCUMENTS

CN 102162403 A 8/2011
CN 106762264 A 5/2017

(Continued)

OTHER PUBLICATIONS

International Search Report for PCT/EP2019/076678 dated Jan. 2, 2020, 5 pages.

(Continued)

*Primary Examiner* — Freddie Kirkland, III
(74) *Attorney, Agent, or Firm* — Nixon & Vanderhye

(57) ABSTRACT

Disclosed is a method for detecting the clogging of an air filter including the following steps when the cross section for the passage of air in an intake tract is greater than a predetermined passage cross section: measuring a pressure in the intake tract at the end of a phase of admitting air into a cylinder; measuring a pressure in the intake tract at the end of an exhaust phase in a cylinder; and determining that the air filter is clogged by comparison between at least one pressure measured during a pressure measurement at the end of the phase of admitting air into a cylinder and, on the other hand, a pressure measured during a pressure measurement at the end of the exhaust phase, the filter being estimated to be clogged when the comparison yields a value higher than a predetermined value.

20 Claims, 2 Drawing Sheets

(56) References Cited

U.S. PATENT DOCUMENTS

| | | | | |
|---|---|---|---|---|
| 8,397,500 | B2 | 3/2013 | Andrasko et al. | |
| 8,573,040 | B2 * | 11/2013 | Guzman | F02M 35/09 73/114.31 |
| 8,701,473 | B2 * | 4/2014 | Uehara | F02M 35/09 73/114.31 |
| 8,959,910 | B2 * | 2/2015 | Rollinger | F02D 41/0007 60/602 |
| 9,429,275 | B2 | 8/2016 | Long et al. | |
| 10,100,790 | B1 * | 10/2018 | Xiao | F02B 39/10 |
| 10,774,760 | B2 * | 9/2020 | Dudar | F02B 37/16 |
| 2003/0028335 | A1 | 2/2003 | Wild et al. | |
| 2008/0190177 | A1 * | 8/2008 | Wiggins | F02M 35/09 73/49.7 |
| 2017/0096974 | A1 * | 4/2017 | Dudar | B60W 20/00 |

FOREIGN PATENT DOCUMENTS

| | | | |
|---|---|---|---|
| DE | 10 056 431 | | 5/2002 |
| DE | 103 58 462 | | 7/2005 |
| DE | 10 2017 223 639 | | 4/2019 |
| EP | 1 464 818 | | 10/2004 |
| FR | 2701217 | | 8/1994 |
| FR | 3 028 565 | A1 | 5/2016 |
| JP | H04-214131 | | 8/1992 |
| JP | 2005-344533 | A | 12/2005 |
| JP | 2009-074410 | | 4/2009 |
| JP | 2012-064718 | | 3/2012 |
| JP | 2013-213617 | | 10/2013 |
| KR | 10-2014-0006941 | | 1/2014 |
| WO | 2016/011617 | | 1/2016 |

OTHER PUBLICATIONS

Written Opinion of the ISA for PCT/EP2019/076678 dated Jan. 2, 2020, 5 pages.

Office Action issued in Chinese Patent Application No. 201980065623.8 dated Feb. 28, 2022.

* cited by examiner

METHOD FOR DETECTING THE CLOGGING OF AN AIR FILTER

CROSS-REFERENCE TO RELATED APPLICATIONS

This application is the U.S. national phase of International Application No. PCT/EP2019/076678 filed Oct. 2, 2019 which designated the U.S. and claims priority to FR 1859260 filed Oct. 5, 2018, the entire contents of each of which are hereby incorporated by reference.

BACKGROUND OF THE INVENTION

Field of the Invention

The present invention relates to a method for detecting the clogging of an air filter in an internal combustion engine.

Description of the Related Art

An air filter is usually replaced on the basis of information provided by the manufacturer. Thus, it may be recommended that an air filter be changed after a predetermined number of hours, it being possible for this number to be determined according to an environment of use (whether this environment is more or less contaminated). However, the true conditions of use are usually not taken into consideration.

It is therefore known practice to use a system for measuring the pressure upstream and downstream of the air filter in order to determine the extent to which it is clogged.

Such a system can be fitted to the air filter as an (aftermarket) option. It comprises two pressure sensors which need to be relatively accurate in order to not give false information.

Document JP2009074410 discloses a method for detecting the clogging of an air filter by an electronic control unit which is a fuel injection control device in which the system for checking the density is designed to determine a quantity of fuel for injection by predicting a quantity of admitted air as a function of the detected rotational speed of the engine and of values of pressure in the intake tract, the difference between the averaged value and the minimum value of the continuously-detected pressures in the intake tract is calculated. When the difference is at least smaller than a predetermined value indicating clogging, the air filter is determined as being clogged, and a breakdown warning light that acts as a display means is illuminated.

This system is incorporated into the original engine but does not require the presence of several pressure sensors. In addition, such a detection system does not work with a carbureted engine. Furthermore, detection of clogging is arrived at when the measured difference in pressure is below a predetermined value. As a result, in order to avoid detection errors, the sensors need to be accurate.

Document DE10358462 relates more particularly to a device for detecting fouling of an air filter for a supercharged combustion engine. Here, detection is performed when the engine is at low idle (no load) and uses two sensors, one sensor for atmospheric pressure and one sensor of the intake pressure, downstream of a compressor.

SUMMARY OF THE INVENTION

It is therefore an object of the present invention to provide a method for detecting the clogging of an air filter that works on the basis of information that is usually accessible in an engine.

To that end, the present invention proposes a method for detecting the clogging of an air filter in an internal combustion engine comprising, on the one hand, at least one piston moving in a cylinder and, on the other hand, a fresh air intake tract and a device able to vary the cross section for the passage of air in said intake tract.

According to the invention, this method comprises the following steps when the cross section for the passage of air in the intake tract is greater than a predetermined passage cross section:

measuring a pressure in the intake tract at the end of a phase of admitting air into a cylinder, measuring a pressure in the intake tract at the end of an exhaust phase in a cylinder, determining that the air filter is clogged by means of a comparison made between, on the one hand, at least one pressure measured during at least one pressure measurement at the end of the phase of admitting air into a cylinder and, on the other hand, at least one pressure measured during at least one pressure measurement at the end of the exhaust phase, the filter being estimated to be clogged when the comparison yields a value higher than a predetermined value.

This method allows the clogging of an air filter to be detected solely by measuring the pressure in the intake tract. A pressure sensor is usually provided in this tract in order to know the flow rate of air entering the engine. The method for detecting clogging thus works with a sensor that is usually present in an engine. Furthermore, since this sensor is present in the engine, the detection of clogging can easily be managed by a control and management unit incorporated into the engine.

The function of detecting clogging can therefore be incorporated directly into the corresponding vehicle (or other device).

In the proposed detection method, the pressure measurement at the end of the phase of admitting air into a cylinder may be performed when the corresponding piston is at its bottom dead center position, for example at ±20° from its bottom dead center position.

Likewise, in this method, the pressure measurement at the end of the exhaust phase in a cylinder may be performed when the corresponding piston is at approximately −30° from its top dead center position, for example between −50° and −10° from its top dead center position.

In order to avoid false detections, the above detection method may make the provision that the air filter is considered to be clogged when several steps of determining the clogging of the air filter have led to an estimate that the air filter is clogged.

In order to indicate clogging to a user, the detection method advantageously also comprises a step of signaling, for example visually or audibly, when a clogging of the air filter is detected.

In the particular case of a two-cylinder engine, the detection method according to the invention comprises the following steps when the cross section for the passage of air in the intake tract is greater than a predetermined passage cross section:

measuring a pressure in the intake tract at the end of a phase of admitting air into a first cylinder, measuring a pressure in the intake tract at the end of a phase of admitting air into the second cylinder, measuring a pressure in the intake tract at the end of an exhaust phase in the first cylinder, determining that the air filter is clogged by calculating the difference between, on the one hand, the pressure measured at the end of the exhaust in the first cylinder and, on the other hand, the mean of the two pressures measured at the end of the phase of admitting air into the first cylinder and into the second cylinder, and by comparing said difference with a predetermined pressure value, the filter being estimated to be clogged when the comparison yields a value higher than said predetermined value.

The present invention also relates to a computer program product, comprising a series of code instructions for implementing a method for detecting the clogging of an air filter in an internal combustion engine as described hereinabove, when said computer program product is implemented by a computer.

The present invention further relates to a device for detecting the clogging of an air filter in an internal combustion engine comprising:

means for determining the engine speed, an electronic computer, a fresh air intake tract, a pressure sensor able to measure the pressure in the intake tract, and a device able to vary the cross section for the passage of air in said intake tract, said device comprising electronic means configured to:

measure a pressure in the intake tract at the end of a phase of admitting air into a cylinder, measure a pressure in the intake tract at the end of an exhaust phase in a cylinder, determine that the air filter is clogged by means of a comparison made between, on the one hand, at least one pressure measured during at least one pressure measurement at the end of the phase of admitting air into a cylinder and, on the other hand, at least one pressure measured during at least one pressure measurement at the end of the exhaust phase, the filter being estimated to be clogged when the comparison yields a value higher than a predetermined value.

Finally, an internal combustion engine, characterized in that it comprises a device for detecting the clogging of an air filter as defined hereinabove, is another subject of the present invention.

BRIEF DESCRIPTION OF THE DRAWINGS

Details and advantages of the present invention will become more clearly apparent from the description that follows, given with reference to the appended schematic drawing in which.

DESCRIPTION OF THE PREFERRED EMBODIMENTS

The description which follows relates to a method for detecting the clogging of an air filter in a combustion engine. Purely by way of nonlimiting illustration, what is considered here is a two-cylinder four-stroke engine. The invention can be implemented with several types of engine, but preferably with single-cylinder or two-cylinder four-stroke engines or with single-cylinder two-stroke engines.

The invention is more specifically, although not exclusively, intended for engines operating under harsh conditions, notably in atmospheres that are particularly heavily laden with dust and/or dirt. This may for example be a machine such as a professional lawnmower which often has to work in an atmosphere that is very heavily laden with dust, or else in another example, this may be a motorbike of the enduro or trail bike type.

Figure 1:
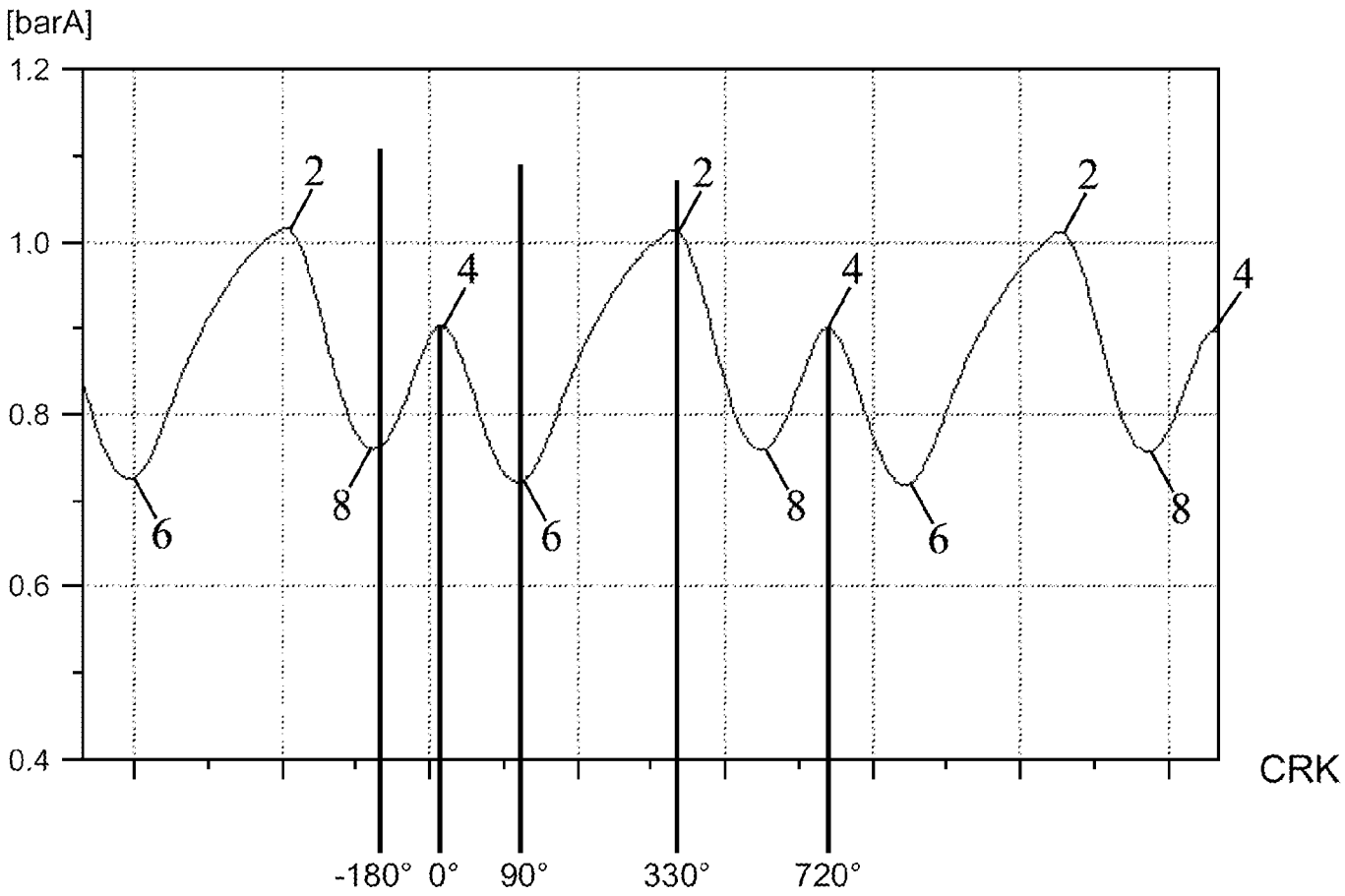
FIG. 1 is a curve of the variation in pressure in an intake tract of a two-cylinder engine.

FIG. 1 illustrates the variation in pressure in an intake tract of a two-cylinder engine in which the two cylinders are mounted in a 90° V. The origin for the angular position of the engine for this figure has been selected as being the top dead center position on a combustion stroke of a first cylinder. As can be seen in this figure, there are main pressure peaks 2 and intermediate pressure peaks 4. Likewise, there are main pressure troughs 6 and intermediate pressure troughs 8. The pressure in the intake tract decreases as air enters a cylinder (generally via the opening of an inlet valve). The pressure increases when there is no longer air entering the cylinders. The opening times for a valve, expressed in degrees of engine rotation, or ° CRK, are substantially the same each time. By contrast, the times for which the two inlet valves (in the case of an engine having four valves) are closed is once short and once longer because of the geometry of the engine (90° V).

Thus, when the two intake valves are closed for the longer period of time, the pressure in the intake tract has a longer time in which to more or less reach the external atmospheric pressure. By contrast, the other times, when the two intake valves are not closed for as long, the pressure in the intake tract does not manage to reach atmospheric pressure when an intake valve opens. Thus there are, on the one hand, the main pressure peaks 2 and, on the other hand, the intermediate pressure peaks 4.

As indicated hereinabove, the opening times of the intake valves are identical. By contrast, as is apparent from FIG. 1, when a valve opens, the pressure in the intake tract corresponds either to a main pressure peak 2 or to an intermediate pressure peak 4. When the pressure on the opening of the intake valve is lower, the pressure on the closing of this valve is thus lower also. The pressure in the intake tract therefore corresponds to a main pressure trough 6.

The invention is based on the following novel observation: if the air filter is clogged, while an intake valve is open, which is a relatively brief period of time, the air drawn into the cylinder will not normally be replaced in the intake tract, thus creating a stronger depression in the intake tract. This is all the more pronounced when an intake valve is opened following an intermediate pressure peak 4.

Figure 2:
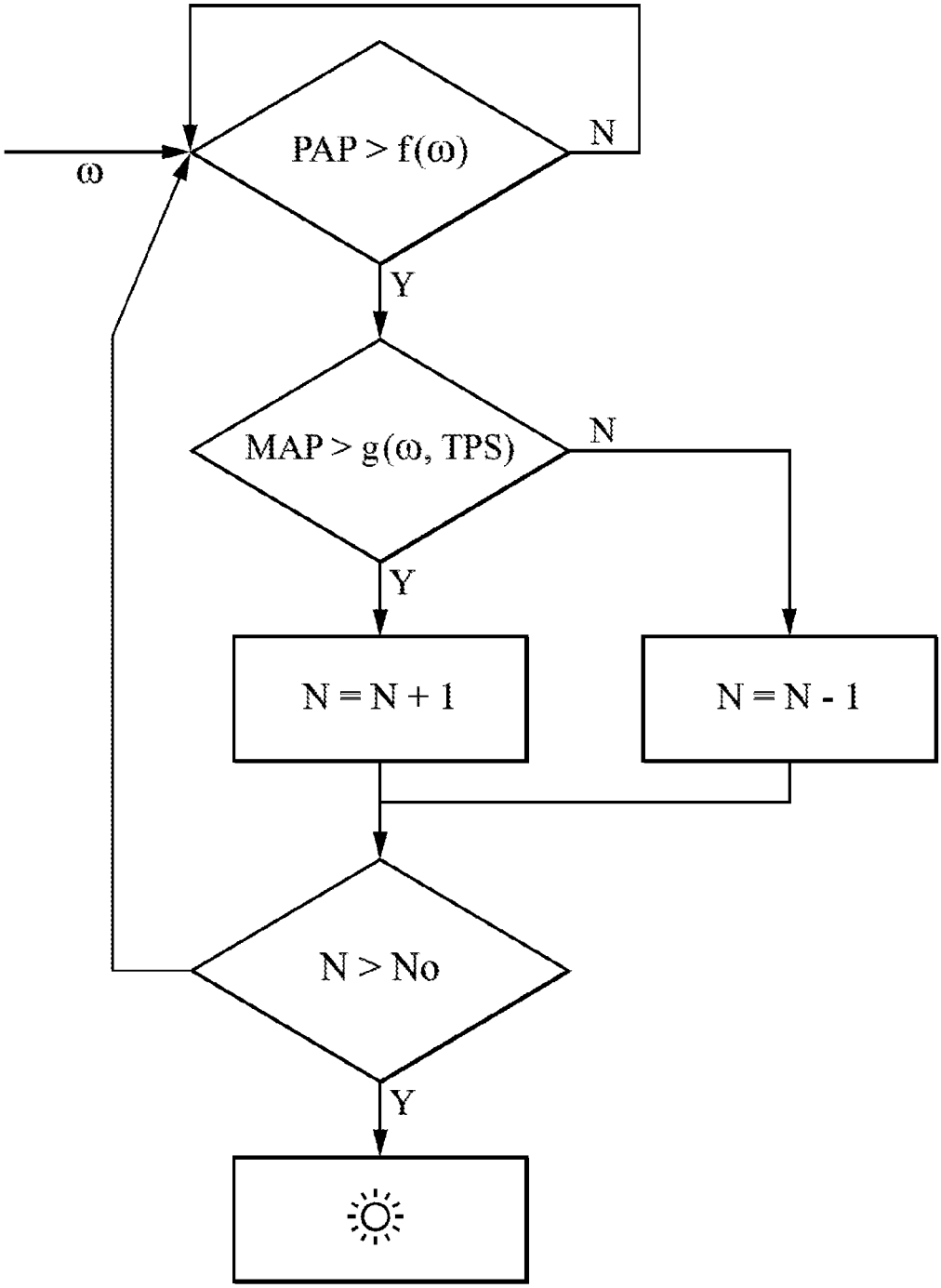
FIG. 2 is a flow diagram illustrating a method for detecting the clogging of an air filter of the engine concerned.

The flow diagram of FIG. 2 therefore proposes measuring the pressure in the intake tract corresponding to successive pressure troughs, an intermediate pressure trough 8 and a main pressure trough 6, calculating the (arithmetic) mean of these and comparing this mean against the pressure value corresponding to the next main pressure peak 2.

The engine is supplied with air via the intake tract. In order to regulate the airflow in the engine, it is common practice to vary the cross section for the passage of air in the tract. In the conventional way, the airflow is regulated using a flap that pivots about an axis perpendicular to the intake tract, which flap is generally referred to (as it likewise is hereinafter) as a "throttle valve".

In order to detect the clogging of an air filter that is situated upstream of the throttle valve, provision is made for pressure measurements to be taken only when the throttle valve is wide open or almost wide open. In a preferred embodiment variant illustrated in FIG. 2, the pressure measurements are taken when the opening of the throttle valve, which can be expressed in degrees (between 0° and 90°), is above a given value as a function of the engine speed ω. The position of opening of the throttle valve is referred to as PAP in FIG. 2. In that figure, the letter "Y" corresponds to "yes", whereas the letter "N" corresponds to "no". Thus, if the opening of the throttle valve is insufficient with respect to the engine speed ω, the invention waits for the throttle valve opening condition to be met before taking the pressure measurements.

When the throttle valve is sufficiently open, a first pressure measurement is taken. This measurement is a measurement of the pressure in the intake tract, downstream of the throttle valve and upstream of the inlet valves. Most engines incorporate a pressure sensor at this point for monitoring the flow rate of air into the engine. The first pressure measurement is always taken when the same first piston reaches its bottom dead center position, namely 180° before the top dead center position for the combustion stroke of the first cylinder. The pressure in the intake tract therefore corresponds to an intermediate pressure trough 8. In the present configuration (a 90° V two-cylinder engine), the next pressure measurement is taken at 90° CRK, namely 270° after the first measurement. It corresponds to the bottom dead center position of the second piston at the end of the intake phase. These pressure measurements are preferably taken at the bottom dead center position. They may also be taken when the one and/or the other piston is in another position near their bottom dead center position, for example at ±20° CRK from this bottom dead center position. The angular position of an engine flywheel of the engine that allows the precise position of the moving parts of this engine to be defined is referred to here, in the conventional way, in ° CRK.

After these two pressure measurements, a third pressure measurement corresponding to a main pressure peak 2 is taken. This peak is reached at the end of the exhaust phase in the first cylinder, namely before the first piston reaches its crossover top dead center position. The third pressure measurement is taken approximately when the piston of the second cylinder begins to re-descend and while the intake valves are still closed. This position corresponds to approximately 30° CRK before the crossover top dead center position of the first piston.

The three pressure measurements in the order in which they are taken are referenced MAP1, MAP2 and MAP3. MAP1 and MAP2 correspond to a pressure trough and MAP3 to a pressure peak.

When these three measurements have been taken, the following are calculated:

the mean of the first two pressures measured, namely (MAP1+MAP2)/2, and the difference, referenced MAP, between MAP3 and this mean:

$$MAP=MAP3-(MAP1+MAP2)/2.$$

When the value MAP is above a predetermined value, it is estimated that the air filter is clogged. The predetermined value is defined as a function of the permissible degree of clogging. It is dependent on the engine speed ω and on the (angular) position of the throttle valve, which position is referenced TPS.

In the above determination of MAP, the value MAP3 is substantially constant and corresponds more or less to atmospheric pressure. The geometry of the intake tract also has an influence on this value, but always in the same way. By contrast, the values MAP1 and MAP2 decrease when the air filter is clogged. This is because the air then has difficulty reaching the engine and a greater depression in the intake tract is then observed when the air is drawn into the cylinders. As a result of this, the difference MAP increases with the clogging of the air filter.

In order to avoid false detections of the clogging of the air filter, provision is preferably made, as illustrated in FIG. 2, for there to be several detections of clogging before the filter is considered as being clogged. Thus, an incremental value N is provided and this is incremented, for example by one unit, when a clogging is detected, and is decremented, for example by one unit, when the value MAP remains below the predefined threshold. Hence, when N exceeds a value No, the air filter is considered as being clogged and an indicator lamp is illuminated.

Reliable detection of the clogging of an air filter is thus achieved and the user is alerted of the need to change this filter by the illuminating of the indicator lamp.

The above method offers the advantage of not requiring the presence of a specific sensor in order to detect the clogging (or fouling or plugging) of an air filter.

Another advantage of this method is that it uses just one sensor. Thus, even if the absolute value measured by the sensor is erroneous, since the detection is based on differences in pressure, the sensor is able to operate reliably. For this reason (a single sensor) also, the detection remains reliable even when the external conditions change: variation in altitude, change in external atmospheric pressure, etc.

The method described can also be adapted to suit two-stroke or four-stroke single-cylinder engines. This method can also be implemented with a carbureted engine. The pressure measurement strategy will need to be adapted according to the engine. The idea is to measure a depression in the intake tract at the end of a phase of admitting air into at least one cylinder and to compare this depression against a "high" pressure in this tract as is produced just after an exhaust phase in a cylinder.

The fact that the detection is performed, on the one hand, when the pressure (or difference in pressure) is above a predetermined threshold and, on the other hand, that this detection is performed as a function of engine parameters (in this instance the engine speed and the angle of opening of the intake throttle valve) means that detection of clogging can be achieved when the air filter is as close as possible to the clogged state.

A person skilled in the art will be able, on the basis of the foregoing description, to envision numerous variants of how to detect clogging of an air filter.

Thus, for example, the number of pressure measurements (low pressure and high pressure) may be adapted. There may be just one, or else more than two, low pressure measurements. Likewise, rather than having a single high pressure measurement, provision may be made for two (or more) high pressure measurements to be taken. When several pressures (of the same type, low or high) are measured, it has been proposed that the arithmetic mean of the measured values be calculated. Another calculation for handling these pressures could be envisioned, for example a weighted mean in order to accord greater significance to a particular measurement.

In order to simplify the method, provision could be made for detection to be performed only when the throttle valve is wide open. This limits the ranges in which detection is performed, but removes nothing from the reliability of the detection.

The way in which false detections are managed may differ entirely from the management proposed hereinabove using the incremental variable N. For example, provision could be made for there to be a predetermined number of successive determinations in order to determine that the filter is clogged.

Of course, the present invention is not restricted to the method embodiment described hereinabove or to the variants mentioned, but also relates to embodiment variants that are within the competence of a person skilled in the art.

The invention claimed is:

1. A method for detecting the clogging of an air filter in an internal combustion engine comprising both at least one piston moving in a cylinder, and also a fresh air intake tract and a device able to vary the cross section for the passage of air in said intake tract, the method comprising the following steps when the cross section for the passage of air in the intake tract is greater than a predetermined passage cross section:

measuring a pressure in the intake tract at the end of a phase of admitting air into a cylinder, measuring a pressure in the intake tract at the end of an exhaust phase in a cylinder, determining that the air filter is clogged by means of a comparison made between both at least one pressure measured during at least one pressure measurement at the end of the phase of admitting air into a cylinder, and also at least one pressure measured during at least one pressure measurement at the end of the exhaust phase, the filter being estimated to be clogged when the comparison yields a value higher than a predetermined value.

2. The detection method as claimed in claim 1, wherein the pressure measurement at the end of the phase of admitting air into a cylinder is performed when the corresponding piston is at bottom dead center position.

3. The detection method as claimed in claim 2, wherein the pressure measurement at the end of the exhaust phase in a cylinder is performed when the corresponding piston is at approximately −30° from top dead center position.

4. The detection method as claimed in claim 2, wherein the air filter is considered to be clogged when several steps of determining the clogging of the air filter have led to an estimate that the air filter is clogged.

5. The detection method as claimed in claim 2, further comprising a step of signaling when a clogging of the air filter is detected.

6. The detection method as claimed in claim 2, wherein the internal combustion engine comprises two pistons each moving in a cylinder, the method further comprising the following steps when the cross section for the passage of air in the intake tract is greater than a predetermined passage cross section:

measuring a pressure in the intake tract at the end of a phase of admitting air into a first cylinder, measuring a pressure in the intake tract at the end of a phase of admitting air into the second cylinder, measuring a pressure in the intake tract at the end of an exhaust phase in the first cylinder, determining that the air filter is clogged by calculating the difference between both the pressure measured at the end of the exhaust in the first cylinder, and also the mean of the two pressures measured at the end of the phase of admitting air into the first cylinder and into the second cylinder, and by comparing said difference with a predetermined pressure value, the filter being estimated to be clogged when the comparison yields a value higher than said predetermined value.

7. The detection method as claimed in claim 1, wherein the pressure measurement at the end of the exhaust phase in a cylinder is performed when the corresponding piston is at approximately −30° from top dead center position.

8. The detection method as claimed in claim 7, wherein the air filter is considered to be clogged when several steps of determining the clogging of the air filter have led to an estimate that the air filter is clogged.

9. The detection method as claimed in claim 7, further comprising a step of signaling when a clogging of the air filter is detected.

10. The detection method as claimed in claim 7, wherein the internal combustion engine comprises two pistons each moving in a cylinder, the method further comprising the following steps when the cross section for the passage of air in the intake tract is greater than a predetermined passage cross section:

measuring a pressure in the intake tract at the end of a phase of admitting air into a first cylinder, measuring a pressure in the intake tract at the end of a phase of admitting air into the second cylinder, measuring a pressure in the intake tract at the end of an exhaust phase in the first cylinder, determining that the air filter is clogged by calculating the difference between both the pressure measured at the end of the exhaust in the first cylinder, and also the mean of the two pressures measured at the end of the phase of admitting air into the first cylinder and into the second cylinder, and by comparing said difference with a predetermined pressure value, the filter being estimated to be clogged when the comparison yields a value higher than said predetermined value.

11. The detection method as claimed in claim 1, wherein the air filter is considered to be clogged when several steps of determining the clogging of the air filter have led to an estimate that the air filter is clogged.

12. The detection method as claimed in claim 11, further comprising a step of signaling when a clogging of the air filter is detected.

13. The detection method as claimed in claim 1, further comprising a step of signaling when a clogging of the air filter is detected.

14. The detection method of claim 13, wherein the signaling is performed visually or audibly.

15. The detection method as claimed in claim 1, wherein the internal combustion engine comprises two pistons each moving in a cylinder, the method further comprising the following steps when the cross section for the passage of air in the intake tract is greater than a predetermined passage cross section:

measuring a pressure in the intake tract at the end of a phase of admitting air into a first cylinder, measuring a pressure in the intake tract at the end of a phase of admitting air into the second cylinder, measuring a pressure in the intake tract at the end of an exhaust phase in the first cylinder, determining that the air filter is clogged by calculating the difference between both the pressure measured at the end of the exhaust in the first cylinder, and also the mean of the two pressures measured at the end of the phase of admitting air into the first cylinder and into the second cylinder, and by comparing said difference with a predetermined pressure value, the filter being estimated to be clogged when the comparison yields a value higher than said predetermined value.

16. A non-transitory computer-readable medium on which is stored a computer program, comprising a series of code instructions for implementing a method for detecting the clogging of an air filter in an internal combustion engine as claimed in claim 1, when said computer program is executed by an electronic computer.

17. The detection method as claimed in claim 1, wherein the pressure measurement at the end of the phase of admitting air into a cylinder is performed when the corresponding piston is ±20° from bottom dead center position.

18. The detection method as claimed in claim 1, wherein the pressure measurement at the end of the exhaust phase in a cylinder is performed when the corresponding piston is between −50° and −10° from top dead center position.

19. A device for detecting the clogging of an air filter in an internal combustion engine comprising:

means for determining the engine speed, an electronic computer, a fresh air intake tract, a pressure sensor able to measure the pressure in the intake tract, and a device able to vary the cross section for the passage of air in said intake tract, wherein said device comprises electronic means configured to:

measure a pressure in the intake tract at the end of a phase of admitting air into a cylinder, measure a pressure in the intake tract at the end of an exhaust phase in a cylinder, determine that the air filter is clogged by means of a comparison made between both at least one pressure measured during at least one pressure measurement at the end of the phase of admitting air into a cylinder, and also at least one pressure measured during at least one pressure measurement at the end of the exhaust phase, the filter being estimated to be clogged when the comparison yields a value higher than a predetermined value.

20. An internal combustion engine, comprising a device for detecting the clogging of an air filter as claimed in claim 19.

* * * * *